US010987725B2

(12) United States Patent
Yamada

(10) Patent No.: US 10,987,725 B2
(45) Date of Patent: Apr. 27, 2021

(54) DECOMPRESSION KNEADER

(71) Applicant: TOYOTA JIDOSHA KABUSHIKI KAISHA, Toyota (JP)

(72) Inventor: Ryo Yamada, Nisshinn (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 255 days.

(21) Appl. No.: 16/166,332

(22) Filed: Oct. 22, 2018

(65) Prior Publication Data

US 2019/0126342 A1 May 2, 2019

(30) Foreign Application Priority Data

Oct. 26, 2017 (JP) ..... JP2017-207103

(51) Int. Cl.
*B22C 5/00* (2006.01)
*B22C 5/04* (2006.01)

(52) U.S. Cl.
CPC ..... *B22C 5/0472* (2013.01)

(58) Field of Classification Search
CPC ..... B22C 5/185; B22C 5/0409; B22C 5/0472; B22C 5/04; B22C 5/0463
See application file for complete search history.

(56) References Cited

U.S. PATENT DOCUMENTS 5,816,312 A * 10/1998 Suginaka ..... B22C 5/185 164/456
2007/0056912 A1* 3/2007 Oder ..... B03C 1/0355 210/695
2009/0158840 A1* 6/2009 Watt ..... G01F 23/64 73/291

FOREIGN PATENT DOCUMENTS

CN 1634691 A 7/2005
CN 105113499 B * 3/2017 ..... G01N 9/36
JP 2000-042686 A 2/2000
JP 2001-150092 A 6/2001
WO WO-2007077427 A2 * 7/2007 ..... B01F 15/00207

OTHER PUBLICATIONS

Zhang Fuhai, CN105113499B, "Test system and method for detecting cement content of pile body of cement stirring pile in real time" (google machine translation), Mar. 2017 (Year: 2017).*

* cited by examiner

*Primary Examiner* — Anshu Bhatia
*Assistant Examiner* — Greg Huan
(74) *Attorney, Agent, or Firm* — Sughrue Mion, PLLC

(57) ABSTRACT

Provided is a decompression kneader capable of stabilizing a moisture content of resultant kneaded sand. The decompression kneader includes a kneader main body configured to knead casting sand and water, a decompression pump configured to reduce a pressure inside the kneader main body, a condenser configured to condense water vapor sucked by the decompression pump, a tank configured to store water condensed by the condenser, and a supply amount calculation apparatus configured to calculate an amount of water supplied from the tank to the kneader main body. The tank comprises a water gauge and a weighing scale, and the supply amount calculation apparatus estimates an amount of the casting sand contained in the tank based on measured values of the water gauge and the weighing scale and corrects the amount of the water supplied from the tank with reference to the amount of the casting sand.

3 Claims, 4 Drawing Sheets

DECOMPRESSION KNEADER

CROSS REFERENCE TO RELATED APPLICATIONS

This application is based upon and claims the benefit of priority from Japanese patent application No. 2017-207103, filed on Oct. 26, 2017, the disclosure of which is incorporated herein in its entirety by reference.

BACKGROUND

The present disclosure relates to a decompression kneader.

A decompression (vacuum) kneader that kneads casting sand and water while reducing a pressure inside the kneader is known.

A method in which a decompression kneader cools water vapor sucked by a decompression pump and supplies the water to an water feed tank to reuse the water is known (e.g., Japanese Unexamined Patent Application Publication No. 2000-42686).

Japanese Unexamined Patent Application Publication No. 2001-150092 discloses a specific method of adjusting kneading that measures, when water is supplied to a kneader, temperature of casting sand and calculates a second correction moisture content based on the temperature in order to determine an amount of water to be supplied.

SUMMARY

In the above-described decompression kneader that reuses water, the casting sand is mixed in the water feed tank, because air and water vapor sucked by the decompression pump contain the casting sand. When the amount of the water to be supplied is calculated without considering the casting sand in the water feed tank, and then the water is supplied, the amount of actually supplied water may be less than the calculated amount.

The present disclosure has been made in view of the above circumstances. An object of the present disclosure is to provide a decompression kneader capable of stabilizing a moisture content of resultant kneaded sand.

An embodiment of a decompression kneader according to the present disclosure includes:

a kneader main body configured to knead casting sand and water;

a decompression pump configured to reduce a pressure inside the kneader main body;

a condenser configured to condense water vapor sucked by the decompression pump;

a tank configured to store water condensed by the condenser; and a supply amount calculation apparatus configured to calculate an amount of water supplied from the tank to the kneader main body.

The tank includes a water gauge and a weighing scale. The supply amount calculation apparatus estimates an amount of the casting sand contained in the tank based on measured values of the water gauge and the weighing scale and corrects the amount of the water supplied from the tank with reference to the amount of the casting sand.

In the embodiment of the decompression kneader according to the present disclosure, the supply amount calculation apparatus stores information about specific gravity of the casting sand and specific gravity of the water, and the supply amount calculation apparatus estimates a weight of the water in the tank or a weight of the casting sand based on the measured values of the water gauge and the weighing scale and the specific gravity of the casting sand and the specific gravity of the water.

In the embodiment of the decompression kneader according to the present disclosure, the tank comprises stirring means, and the stirring means stirs the water before the water is supplied from the tank to the kneader main body.

The present disclosure can provide a decompression kneader that is capable of stabilizing a moisture content of resultant kneaded sand.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Figure 1:
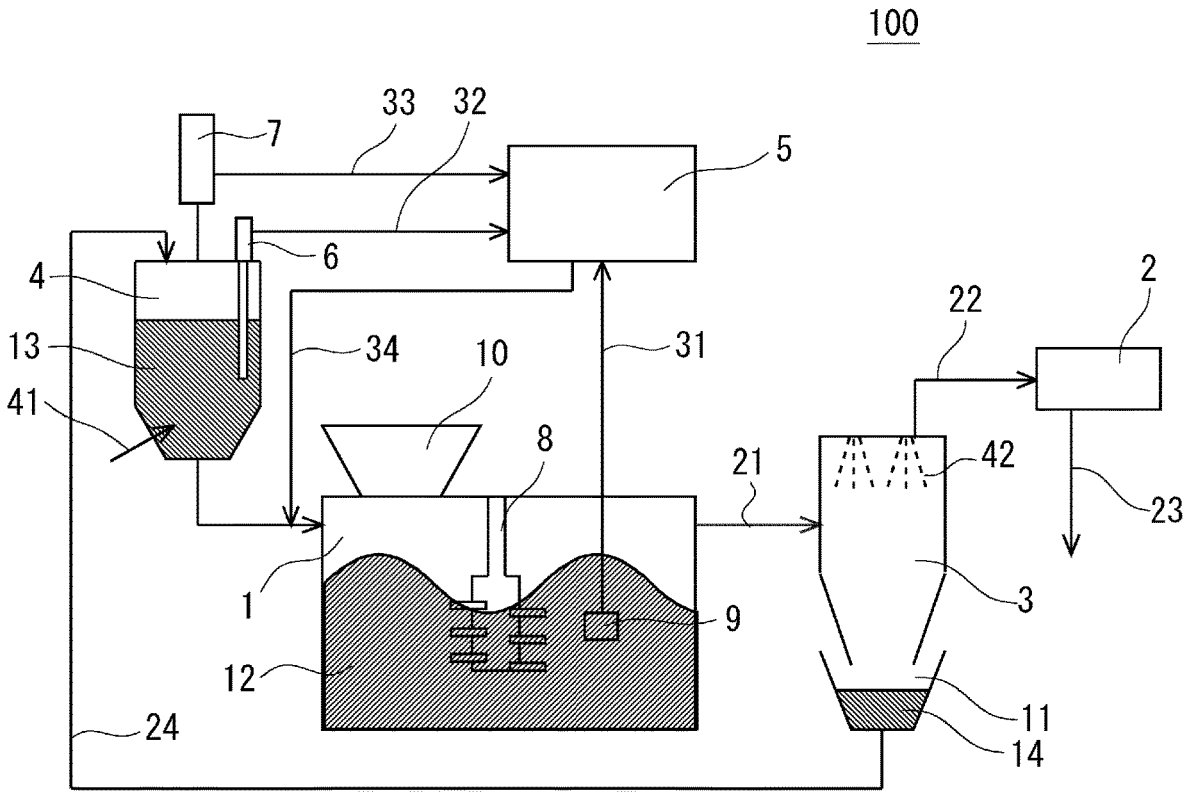
FIG. 1 is a schematic diagram showing an example of a decompression kneader according to the present disclosure.

First, a decompression kneader according to this embodiment will be described with reference to FIG. 1. FIG. 1 is a schematic diagram showing one embodiment of the decompression kneader. A decompression kneader 100 according to this embodiment shown in the example of FIG. 1 includes a kneader main body 1 that kneads a mixture 12 composed of casting sand and water, a decompression pump 2 that reduces the pressure inside the kneader main body, a condenser 3 that condenses water vapor sucked by the decompression pump, a tank 4 that stores water 14 condensed by the condenser, and a supply amount calculation apparatus 5 that calculates an amount of water supplied from the tank 4 to the kneader main body 1. The tank 4 includes a water gauge 6 for measuring a water level of water 13 in the tank and a weighing scale 7 for measuring a weight of the water 13 in the tank.

The kneader main body 1 includes a kneader 8 and a moisture sensor 9 for measuring moisture of the casting sand in the kneader main body in a pressure reducible container. The kneader main body 1 is connected to the tank 4 in a state in which the water 13 in the tank can be supplied thereto. Usually, the kneader main body 1 further includes a casting sand tank 10. A container of the kneader main body 1 usually includes a sealable takeout port (not shown) for taking out kneaded casting sand (kneaded sand).

When the casting sand tank 10 is included in the kneader main body 1, the casting sand tank 10 can store collected sand, which is used kneaded sand that has been collected, to be reused. The collected sand usually contains moisture.

The decompression pump 2 is connected to the kneader main body 1 with the condenser 3 interposed therebetween via pipes 21 and 22 through which gas passes. The decompression pump 2 sucks air and water vapor inside the kneader main body. The sucked air and water vapor contain the casting sand. In the condenser 3, the sucked water vapor is condensed and collected as liquid water. A method of condensing the water vapor is not particularly limited. Examples of the method of condensing the water vapor include spraying cooling water 42 in a shower form on the water vapor to cool the water vapor. The water obtained by condensing the water vapor is collected together with the cooling water 42 by a receiving pan 11 or the like disposed under the condenser 3. At this time, the casting sand contained in the water vapor is also collected by the receiving pan 11. In the example of FIG. 1, the condenser 3 and the receiving pan 11 are separated, but the receiving pan 11 may be integrated with the condenser 3, so as to form a bottom part of the condenser 3. The air and water vapor not condensed and the like are discharged 23 through the decompression pump 2.

The collected water 14 including the casting sand is supplied to the tank 4 through a pipe 24 by known means such as a pump. Therefore, the water 13 in the tank contains the casting sand.

A part of a supernatant of the collected water 14 may be used as the cooling water 42, which is not shown.

The tank 4 includes the water gauge 6 for measuring the water 13 in the tank and the weighing scale 7. The water gauge 6 is only required to be able to measure the water level of the water 13 in the tank. The water gauge 6 may be any one of, for example, a float type, a capacitance type, an ultrasonic type, and a guide pulse type. It is preferable to use a guide pulse water gauge, because it rarely makes a false detection and achieves stable accuracy. The weighing scale 7 can be appropriately selected from known ones to be used. For example, a suspended scale using a load cell or a spring may be used as the weighing scale 7.

The tank 4 may include stirring means for stirring the water 13 in the tank. The casting sand settled in the water can be uniformly dispersed by this stirring, thereby reducing variations in moisture to be supplied. Examples of the stirring means include supplying air 41 to the water inside the tank and stirring the water by bubbles. A known stirrer (not shown) may be used for the stirring.

The decompression kneader according to this embodiment includes the supply amount calculation apparatus 5 that calculates the amount of the water supplied from the tank 4 to the kneader main body 1. In this embodiment, the supply amount calculation apparatus 5 estimates the amount of the casting sand contained in the water 13 in the tank based on the measured value of the water gauge 6 and the measured value of the weighing scale 7, and determines the amount of the water supplied from the tank 4 with reference to the estimated amount of the casting sand. Thus, a moisture content in the casting sand can be made constant at the start of kneading. As a result, it is possible to reduce and stabilize the variation in the moisture content of the resultant kneaded sand.

The supply amount calculation apparatus 5 includes input units (31, 32, and 33) that receive the measured values of the water gauge 6, the weighing scale 7, and the moisture sensor 9, respectively, a calculation unit that determines the amount of the water supplied from the tank, and a control unit that controls (34) the amount of the water supplied from the tank. The supply amount calculation apparatus 5 preferably includes a storage unit that stores information about specific gravity of the casting sand and the water. The supply amount calculation apparatus 5 may be a general-purpose computer.

Method of Using Decompression Kneader

Figure 2:
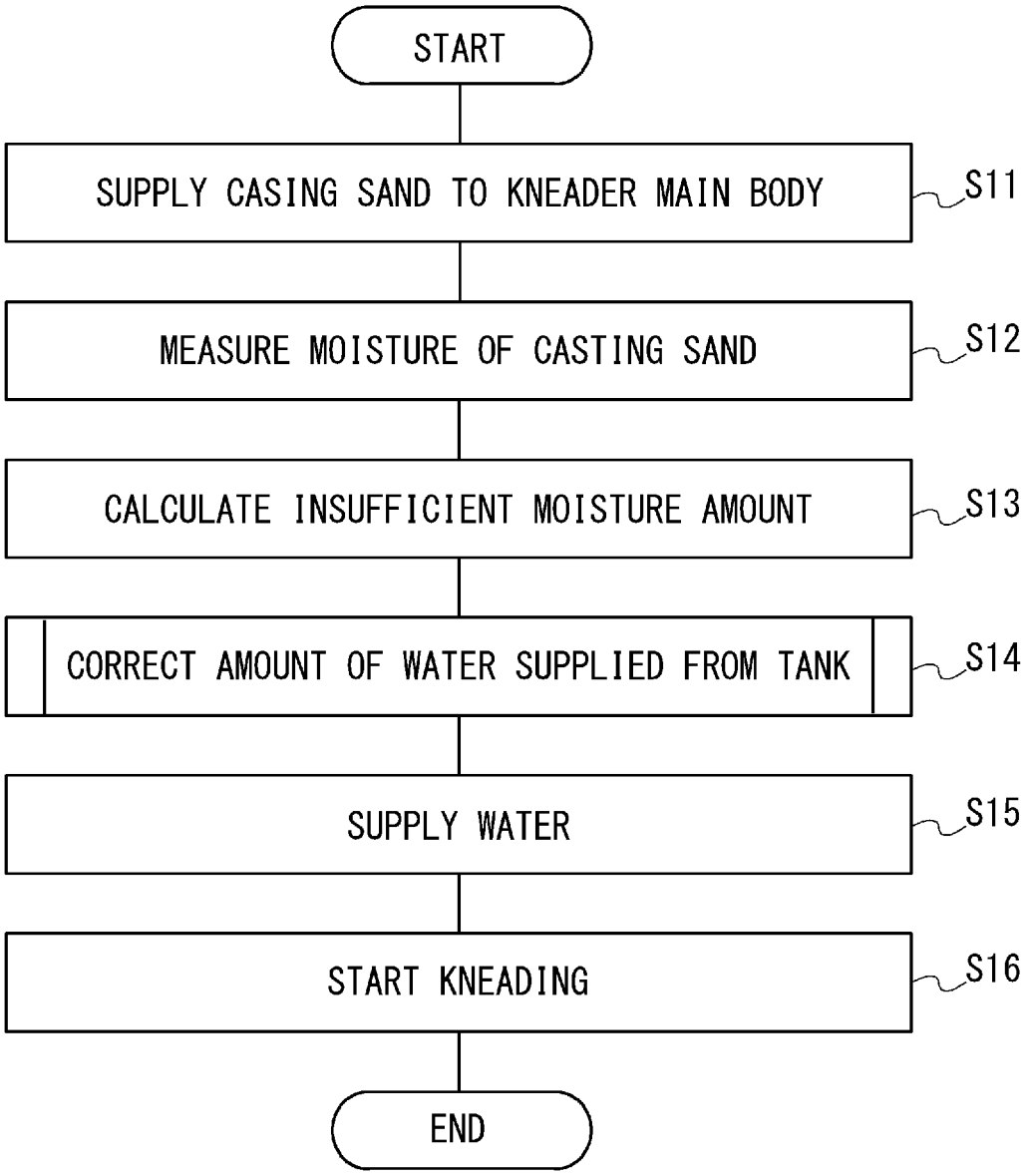
FIG. 2 is a flowchart showing an example of a method of using the decompression kneader.

The method of using the decompression kneader according to this embodiment will be described with reference to FIG. 2. FIG. 2 is a flowchart showing an example of the method of using the decompression kneader according to this embodiment. In the example of FIG. 2, firstly the casting sand (collected sand) is supplied to the kneader main body 1 (S11). The casting sand can be appropriately selected from known ones to be used. Specific examples of the casting sand include silica sand and mountain sand, and may contain, as necessary, a binder such as bentonite, water glass, synthetic resin, and an additive such as starch and lime powder. When the collected sand is used, insufficient additives together with the collected sand may be supplied to the kneader main body 1.

Next, the moisture of the casting sand in the kneader main body 1 is measured by the moisture sensor 9 (S12). The measured value is input 31 to the supply amount calculation apparatus 5 and the like. The supply amount calculation apparatus 5 refers to the total weight of the content of the kneader main body 1, which is separately measured or managed, to calculate the amount of moisture necessary for obtaining a predetermined moisture content (insufficient moisture amount (weight: m)) (S13). The predetermined moisture content is the moisture content of the casting sand before being kneaded, which is adjusted so as to make the moisture content of the resultant kneaded sand obtained after the kneading be a target moisture content. The predetermined moisture content is appropriately set according to kneading conditions and the like. Information about the predetermined moisture content is stored in advance in the supply amount calculation apparatus 5 and the like.

Figure 5:
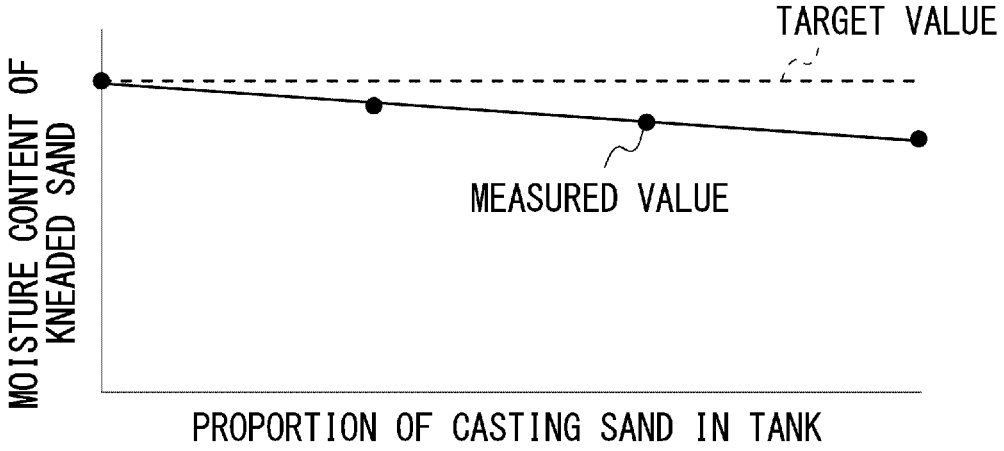
FIG. 5 is a graph showing a moisture content of the resultant kneaded sand when the amount of water supplied from the tank is not corrected.

The tank 4 contains not only the water but also the casting sand and the like. Thus, when the amount of the water supplied from the tank is set as the insufficient moisture amount calculated in S13, the amount of actually supplied water is insufficient for the amount of the mixed casting sand. FIG. 5 is a graph showing the moisture content of the resultant kneaded sand when the amount of the water supplied from the tank is not corrected. In FIG. 5, the dotted line is the target moisture content of the kneaded sand obtained after the kneading, and the measured value is the moisture content of the resultant kneaded sand. In the example of FIG. 5, the insufficient moisture amount calculated in S13 is used as the amount of the water supplied from the tank. As shown in the example of FIG. 5, it can be seen that as the proportion of the casting sand in the tank increases, the moisture content of the resultant kneaded sand decreases, deviating from the target value. For this reason, in this embodiment, the amount of water supplied from the tank is corrected (S14).

Figure 3:
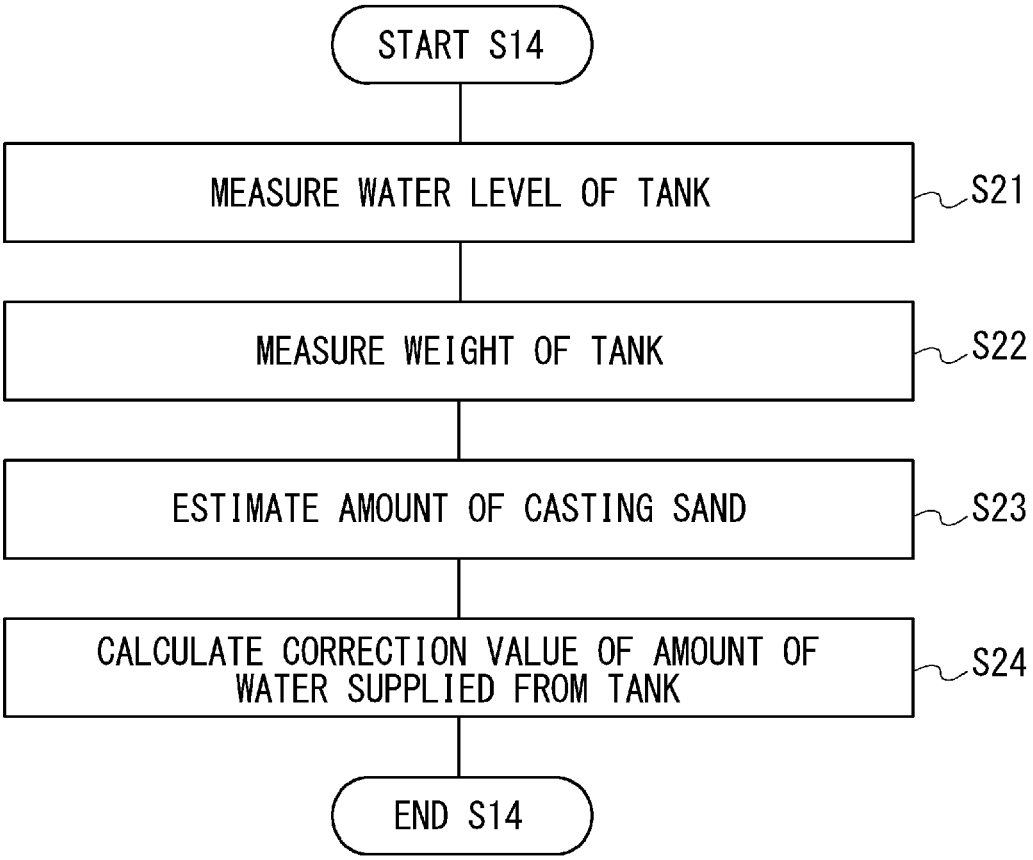
FIG. 3 is a flowchart showing an example of a method of correcting an amount of water supplied from a tank.

A method of correcting the amount of the water supplied from the tank will be described with reference to FIG. 3. FIG. 3 is a flowchart showing an example of the method of correcting the amount of the water supplied from the tank. First, the water level of the water in the tank is measured by the water gauge 6 included in the tank 4, and the weight of the tank is measured by the weighing scale 7 included in the tank 4 (S21 and S22). The order of S21 and S22 may be reversed or simultaneous. The obtained measured values are input (32 and 33) to the supply amount calculation apparatus 5. The supply amount calculation apparatus 5 calculates the volumes (Lt), the weights (Mt), and the apparent specific gravity (Xt=Mt/Lt) of all the contents (the water and casting sand) in consideration of the shape and weight of the tank.

Next, the amount of the casting sand is estimated from these measured values (S23). Hereinafter, a method of estimating the casting sand will be described in detail using two examples.

1. When the Casting Sand Includes One Component

First, the case where the casting sand includes one component will be described. Here, the specific gravity of the water is Xa, the weight of the water in the tank is Ma, the volume of the water in the tank is La, the specific gravity of the casting sand is Xb, the weight of the casting sand in the tank is Mb, and the volume of the casting sand in the tank is Lb. Then, the following Formulas (1) to (5) are satisfied.

$$Ma+Mb=Mt \quad \text{Formula (1)}$$

$$La+Lb=Lt \quad \text{Formula (2)}$$

$$Mt/Lt=Xt \quad \text{Formula (3)}$$

$$Ma/La=Xa \quad \text{Formula (4)}$$

$$Mb/Lb=Xb \quad \text{Formula (5)}$$

The following Formula (6) is obtained from the above Formulas (1) to (5).

$$La=(Mt-Lt\cdot Xb)/(Xa-Xb) \quad \text{Formula (6)}$$

The specific gravity Xa of the water shall be 1. Further, a literature value may be used for the specific gravity Xb of the casting sand, or a value measured in advance may be used for the apparent specific gravity Xb of the casting sand. That is, Xa and Xb are known constants. Thus, the volume La of the water in the tank can be calculated by Formula (6). The insufficient moisture amount calculated in S13 is insufficient only by the weight of the casting sand Mb=Mt−Xa·La. In this case, a correction value Mα is calculated according to the following Formula (7) (S24).

$$M\alpha=m\cdot(Mb/Mt)\cdot Xt \quad \text{Formula (7)}$$

In Formula (7), m is the insufficient moisture amount m calculated in the above S13, and Mb/Mt is the proportion of the casting sand in the tank 4.

2. When the Casting Sand Includes Two Components

Next, the case where the casting sand includes two components (which are referred to as a first component and a second component) will be described. For example, the casting sand contains quartz sand and bentonite. Here, the apparent specific gravity of the water is Xa, the weight of the water in the tank is Ma, the volume of the water in the tank is La, the apparent specific gravity of the first component is Xb, the weight of the first component in the tank is Mb, the volume of the first component inside the tank is Lb, the specific gravity of the second component is Xc, the weight of the second component in the tank is Mc, and the volume of the second component in the tank is Lc. Then, the following Formulas (8) to (13) are satisfied.

$$Ma+Mb+Mc=Mt \quad \text{Formula (8)}$$

$$La+Lb+Lc=Lt \quad \text{Formula (9)}$$

$$Mt/Lt=Xt \quad \text{Formula (10)}$$

$$Ma/La=Xa \quad \text{Formula (11)}$$

$$Mb/Lb=Xb \quad \text{Formula (12)}$$

$$Mc/Lc=Xc \quad \text{Formula (13)}$$

From the above Formulas (8) to (13), La can be calculated in the same manner as in the case where the casting sand includes one component. The insufficient moisture amount m calculated in S13 is insufficient only by the weight of the casting sand Mb+Mc=Mt−Xa·La. In this case, the correction value Mβ is calculated by the following Formula (14).

$$M\beta=m\cdot\{(Mb+Mc)/Mt\}\cdot Xt \quad \text{Formula (14)}$$

When the casting sand includes three or more components, the correction value can be calculated in the manner similar to the above case. The correction value Mα when the casting sand is a mixture including two or more components can be calculated by the calculation method for the casting sand including one component using the apparent specific gravity of the mixture, provided that the composition ratio of the respective components is constant.

An amount of the water obtained by adding the correction value (Mα or Mβ) of the amount of the water calculated in S14 to the insufficient moisture amount (m) calculated in S13 is supplied from the tank 4 to the kneader main body 1 (S15). Then, the casting sand in the kneader main body 1 is adjusted to a predetermined moisture content. In this embodiment, the water is preferably stirred before it is supplied from the tank 4 to the kneader main body 1. The casting sand settled in the tank can be uniformly dispersed by this stirring while the water is being supplied.

In this manner, the casting sand adjusted to the predetermined moisture content can be prepared in the kneader main body 1. Next, the casting sand is kneaded under appropriately set kneading conditions (S16). In this way, it is possible to obtain the kneaded sand with reduced variation in the moisture content.

Figure 4:
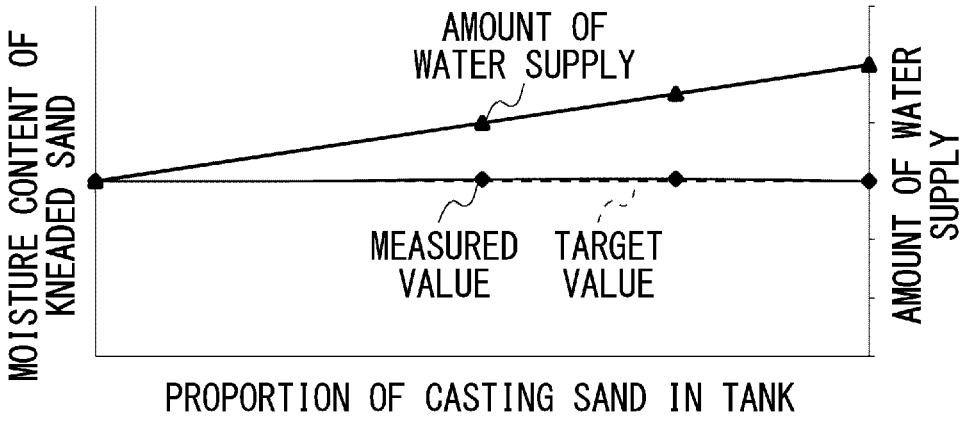
FIG. 4 is a graph showing a moisture content of resultant kneaded sand when the amount of water supplied from the tank is corrected using the decompression kneader according to an embodiment.

FIG. 4 is a graph showing the moisture content of the resultant kneaded sand when the amount of water supplied from the tank is corrected using the decompression kneader according to this embodiment. In FIG. 4, the dotted line is the target moisture content of the kneaded sand obtained after the kneading, and the measured value is the moisture content of the resultant kneaded sand. In FIG. 4, the point on the left vertical axis represents the case where the insufficient moisture amount (m) calculated in S13 is supplied when the casting sand is not included in the tank. As shown in the example of FIG. 4, even when the proportion of contaminants in the tank increases, the insufficient moisture amount (m) is corrected by the above-described correction value, so that the moisture content of the kneaded sand can be stabilized around the target value.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A decompression kneader comprising:

a kneader main body configured to knead casting sand and water;

a decompression pump configured to reduce a pressure inside the kneader main body;

a condenser configured to condense water vapor sucked by the decompression pump; and a tank including a water gauge and a weighing scale, the tank being configured to store water condensed by the condenser; and a computer including a storage and configured to calculate an amount of water supplied from the tank to the kneader main body by estimating an amount of the casting sand contained in the tank based on measured values of the water gauge and the weighing scale and correcting the amount of the water supplied from the tank with reference to the amount of the casting sand.

2. The decompression kneader according to claim 1, wherein the computer stores, in its storage, information about apparent specific gravity of the casting sand and apparent specific gravity of the water, and is further configured to calculate the amount of water supplied from the tank to the kneader main body by estimating a weight of the water in the tank or a weight of the casting sand based on the measured values of the water gauge and the weighing scale and the apparent specific gravity of the casting sand and the apparent specific gravity of the water.

3. The decompression kneader according to claim 1, wherein the tank comprises stirring means, and the stirring means stirs the water before the water is supplied from the tank to the kneader main body.

* * * * *